US006679791B2

(12) United States Patent
Watanabe

(10) Patent No.: US 6,679,791 B2
(45) Date of Patent: Jan. 20, 2004

(54) GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/880,844

(22) Filed: Jun. 15, 2001

(65) Prior Publication Data

US 2002/0019269 A1 Feb. 14, 2002

(30) Foreign Application Priority Data

Jun. 26, 2000 (JP) ..... 2000-190640

(51) Int. Cl.[7] ..... A63B 37/04; A63B 37/06; A63B 37/00

(52) U.S. Cl. ..... 473/371; 473/351

(58) Field of Search ..... 473/251–377

(56) References Cited

U.S. PATENT DOCUMENTS

| | | | | | |
|---|---|---|---|---|---|
| 5,002,281 | A | * | 3/1991 | Nakahara et al. | 473/373 |
| 5,072,944 | A | * | 12/1991 | Nakahara et al. | 473/373 |
| 5,184,828 | A | | 2/1993 | Kim et al. | |
| 5,645,496 | A | | 7/1997 | Endo et al. | |
| 5,711,723 | A | | 1/1998 | Hiraoka et al. | |
| 5,782,707 | A | * | 7/1998 | Yamagishi et al. | 473/374 |
| 5,803,833 | A | * | 9/1998 | Nakamura et al. | 473/377 |
| 5,830,085 | A | * | 11/1998 | Higuchi et al. | 473/373 |
| 6,190,269 | B1 | * | 2/2001 | Moriyama | 473/373 |
| 6,287,218 | B1 | * | 9/2001 | Ohama | 473/377 |
| 6,315,682 | B1 | * | 11/2001 | Iwami et al. | 473/370 |
| 6,319,155 | B1 | * | 11/2001 | Moriyama et al. | 473/371 |
| 6,336,872 | B1 | * | 1/2002 | Moriyama et al. | 473/374 |
| 6,354,967 | B1 | * | 3/2002 | Nakamura et al. | 473/377 |
| 6,358,159 | B1 | * | 3/2002 | Yamagishi et al. | 473/374 |
| 6,379,268 | B1 | * | 4/2002 | Yamagishi et al. | 473/371 |

FOREIGN PATENT DOCUMENTS

| | | |
|---|---|---|
| JP | 10-127823 | 5/1998 |
| JP | 11-290479 | 10/1999 |
| JP | 11-333026 | 12/1999 |

OTHER PUBLICATIONS

Farrally, M.R. et al., Science and Golf III: Proceedings of the 1998 World Scientific Congress of Golf, Illinois: Human Kinetics, copyright 1999, p. 413.*

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A multi-piece golf ball includes a rubbery elastic core, a cover having a plurality of dimples on the surface thereof, and at least one intermediate layer between the core and the cover. The intermediate layer is composed of a resin material which is harder than the cover. The elastic core has a hardness which gradually increases radially outward from the center to the surface thereof. The center and surface of the elastic core have a hardness difference of at least 18 JIS-C hardness units. This construction and combination of features improve the distance of the ball when struck with a driver, provide the ball with excellent spin characteristics and thus good controllability on approach shots, and gives the ball a good feel on impact, enabling the ball to meet the high expectations of skilled golfers.

27 Claims, 1 Drawing Sheet

GOLF BALL

BACKGROUND OF THE INVENTION

1. Field of the Invention

The present invention relates to a golf ball having a multilayer construction of at least three layers which includes a core, an intermediate layer and a cover. More particularly, the invention relates to a golf ball which has good rebound characteristics and provides an excellent travel distance, controllability and "feel" upon impact with a golf club.

2. Prior Art

In recent years, solid golf balls, with their good flight performance, have consistently won greater general approval than conventional thread-wound golf balls.

Solid golf ball constructions include two-piece balls made of a solid, high-resilience, rubber core enclosed within a relatively thin resin cover, and multi-piece balls having a core, a cover, and also an intermediate layer therebetween whose properties differ somewhat from those of the cover.

As already noted, because of their good flight performance (i.e., long travel distance), solid golf balls of these types are widely favored by both amateur and professional golfers. Yet, there remains a desire among golfers for even better flight performance.

SUMMARY OF THE INVENTION

It is therefore an object of the present invention to provide a golf ball having a multilayer construction of three or more layers that is endowed with improved distance without diminishing the controllability and feel that are so important to skilled golfers.

Accordingly, the invention provides a golf ball comprising a rubbery elastic core having a center and a radially outer surface, a cover having a plurality of dimples on the surface thereof, and at least one intermediate layer situated between the core and the cover. The intermediate layer is composed of a resin material which is harder than the cover. The elastic core has a hardness which gradually increases radially outward from the center to the surface thereof, and a difference in JIS-C hardness of at least 18 between the center and the surface.

Preferably, the JIS-C hardness at the center of the core is 50 to 65, and the JIS-C hardness at the surface of the core is 70 to 90. The core typically undergoes a deformation of 3.0 to 5.0 mm when the load applied thereto is increased from an initial load of 98 N (10 kgf) to a final load of 1,275 N (130 kgf).

BRIEF DESCRIPTION OF THE DRAWING

The objects, features and advantages of the invention will become more apparent from the following detailed description, taken in conjunction with the accompanying diagram.

The only FIGURE.

DETAILED DESCRIPTION OF THE INVENTION

Figure 1:
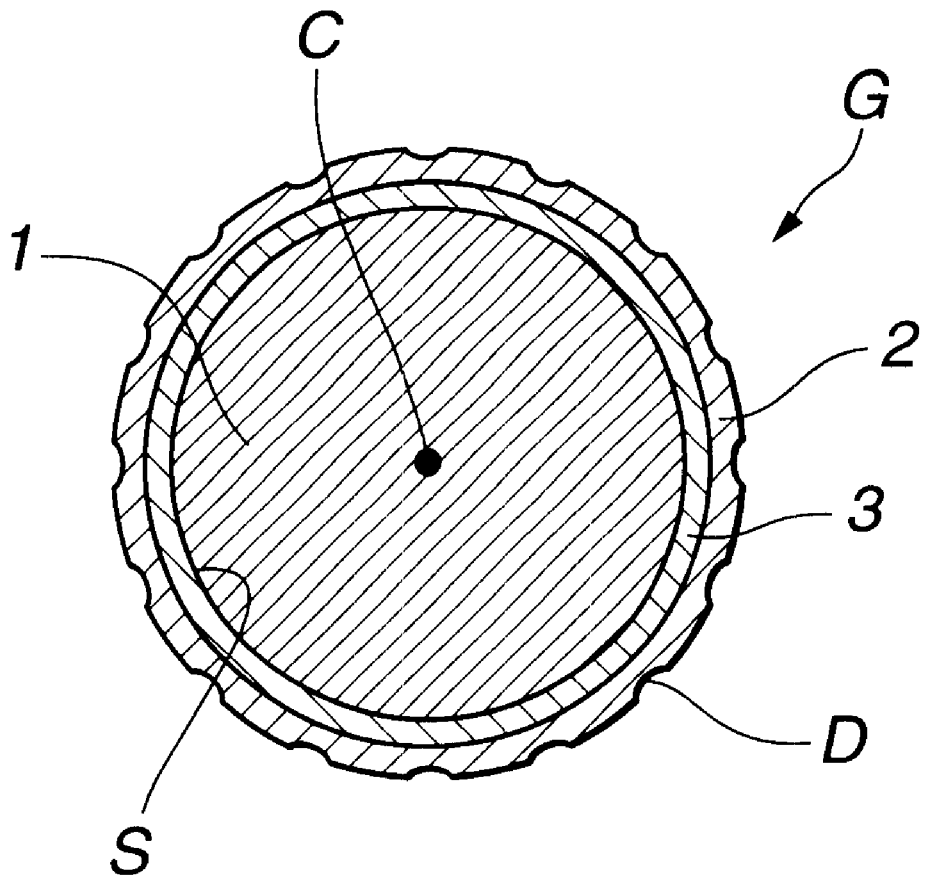
FIG. 1 is a sectional view showing a golf ball according to one embodiment of the invention.

Referring to FIG. 1, the golf ball G of the present invention has a construction composed of at least three layers, commonly known as a "multi-piece construction," which include a rubbery elastic core 1, a cover 2 that is generally made of a resin material and has a plurality of dimples D on the surface thereof, and one or more intermediate layer 3 between the core 1 and the cover 2, all situated in a concentric fashion. The illustrated embodiment has a single intermediate layer. The intermediate layer 3 is made of a resin material which is harder than the cover 2. The core 1 having a center C and a surface S at its radially outer extremity has a JIS-C hardness which gradually increases radially outward from the center C to the surface S. The core 1 is formed so as to have a specific hardness difference between the surface S and the center C.

The inventive golf ball includes a hard intermediate layer disposed between the core, which has an optimized hardness profile, and the cover which is softer than the intermediate layer. This construction provides the ball with an excellent "feel," holds down spin when the ball is struck with a driver, and increases the distance traveled, in part by creating a trajectory which does not describe a high arc when traveling into a headwind. At the same time, it increases the amount of spin on approach shots taken with a club having a large loft angle, thus imparting the excellent control desired in particular by professionals and other skilled golfers.

In the golf ball of the present invention, the core may be made from a known core material which is prepared by blending, for example, a base rubber, the metal salt of an unsaturated carboxylic acid, and an organic peroxide.

The base rubber is preferably polybutadiene. The use of 1,4-polybutadiene, and especially one having a cis structure of at least 40%, is recommended. In addition to the polybutadiene, the base rubber may also include other rubbers such as natural rubber, polyisoprene rubber and styrene-butadiene rubber, if necessary.

Examples of suitable metal salts of unsaturated carboxylic acids include zinc dimethacrylate and zinc diacrylate. Zinc diacrylate is especially preferred for achieving a high rebound energy. It is advantageous to include such unsaturated carboxylic acids in an amount of at least 15 parts by weight, and preferably at least 20 parts by weight, but not more than 50 parts by weight, and preferably not more than 45 parts by weight, per 100 parts by weight of the base rubber.

Examples of suitable organic peroxides include 1,1-bis(t-butylperoxy)-3,3,5-trimethylcyclohexane, dicumyl peroxide, di-(t-butylperoxy)-m-diisopropylbenzene and 2,5-dimethyl-2,5-di-t-butylperoxyhexane. It is advantageous to include such peroxides in an amount of at least 0.1 part by weight, and preferably at least 0.5 part by weight, but not more than 5 parts by weight, and preferably not more than 2 parts by weight, per 100 parts by weight of the base rubber.

To impart good rebound characteristics, it is advisable to include a suitable compounding ingredient such as a thiophenol, thionaphthol, halogenated thiophenol or metal salt thereof in the core material. Specific examples of such compounding ingredients that may be used include pentachlorothiophenol, pentafluorothiophenol, pentabromothiophenol, p-chlorothiophenol and the zinc salt of pentachlorothiophenol. The zinc salt of pentachloro-thiophenol is especially preferred. Such a compounding ingredient is typically included in an amount of at least 0.4 part by weight, and preferably at least 0.6 part by weight, but not more than 2.0 parts by weight, and preferably not more than 1.2 parts by weight, per 100 parts by weight of the base rubber. Too much of this ingredient tends to lower the core hardness, which can adversely impact the feel of the ball when hit as well as its durability (cracking resistance), whereas too little may lower the rebound energy of the core, making it impossible for the ball to achieve a sufficient carry.

If necessary, the core material may include also various additives such as inorganic fillers and antioxidants. Illustrative examples of such additives include zinc oxide, barium sulfate and calcium carbonate.

The core may be fabricated from the above core material by using a conventional process to blend the various ingredients and mold the resulting mixture. For example, the constituent ingredients may be blended in a suitable apparatus such as a Banbury mixer or a kneader to form a "slug," which is then placed in a mold where it is vulcanized at a temperature of generally at least 150° C., and preferably at least 160° C., but generally not more than 190° C., and preferably not more than 180° C. The period of vulcanization is generally at least 8 minutes, and preferably at least 12 minutes, but generally not more than 20 minutes, and preferably not more than 16 minutes.

The weight and diameter of the core may be suitably adjusted according to such factors as the constituent materials and thickness of the intermediate layer and the cover, which are described subsequently. It is recommended that the core generally have a weight of at least 23 g, and preferably at least 30 g, but not more than 37 g, and preferably not more than 35 g. It is also recommended that the core generally have a diameter of at least 33 mm, and preferably at least 36 mm, but not more than 39 mm, and preferably not more than 38 mm.

It is critical for the core to have an optimized hardness profile in which the hardness gradually increases radially outward from the center toward the outside edge or surface of the core. That is, the core has a higher hardness at the surface than at the center.

The core center and surface must have a difference between their respective measured JIS-C hardnesses of at least 18, preferably at least 20, and most preferably at least 22 units. This difference in hardness within the core gives the ball a low spin when hit with a driver (number 1 wood), enabling it to travel well and thus attain a good total distance. Too small a difference in JIS-C hardness between the relatively soft center and the relatively hard surface of the core allows the ball to take on too much spin when hit with a driver, so that it does not travel well and has a short run after it lands on the ground. This makes it impossible to achieve the desired distance. It is recommended that the upper limit in the hardness difference be at most 30, preferably 27 or less, and most preferably 25 units or less.

Specifically, the core at the center typically has a JIS-C hardness of at least 50, and preferably at least 55, but not more than 65, and preferably not more than 62. The core at the surface typically has a JIS-C hardness of at least 70, and preferably at least 75, but not more than 90, and preferably not more than 85. Too low a JIS-C hardness at the core center may deaden the feel and fail to achieve the desired rebound energy, whereas a hardness that is too high may result in an excessively hard feel when the ball is hit. Similarly, too low a JIS-C hardness at the core surface may deaden the feel of the ball when hit, while too high a hardness may result in too hard a feel.

Preferably the core of the inventive golf ball has a deformation of at least 3.0 mm, and preferably at least 3.3 mm, but not more than 5.0 mm, and preferably not more than 4.5 mm, when the load applied thereto is increased from an initial load of 98 N (10 kgf) to a final load of 1,275 N (130 kgf). Too small a deformation may increase the spin when the ball is hit with a driver, preventing the desired travel from being achieved, and may also give the ball too hard a feel. On the other hand, too much deformation may deaden the feel and fail to achieve the necessary rebound energy.

Since the core has a hardness gradually increasing radially outward from the center to the surface thereof and an optimized difference in hardness between the center and the surface where the core is hardest, the inventive golf ball having the above-described core functions to suppress the generation of excessive spin when it is hit with a driver, effectively increasing the run after it lands on the ground, and thus travelling a longer total distance.

The intermediate layer 3 of the inventive golf ball is an essential layer which is situated between the core 1 and the cover 2 of the ball G, as shown in FIG. 1, and is made of a resin material that is harder than the cover material. Even if the core and cover are within the scope of the present invention, a golf ball lacking the adequate intermediate layer prescribed by the present invention fails to attained the objects of the invention since it cannot adequately suppress spin when hit with a driver, making it impossible to achieve a longer travel distance, and gives a poor feel when hit.

The intermediate layer may be made using a known cover material, illustrative examples of which include an ionomer resin, either by itself or in admixture with a polyester, polyurethane, polyamide, polyolefin or polystyrene thermoplastic elastomer. The use of an ionomer resin by itself is especially preferred, although another thermoplastic resin may be used provided the resin material for the intermediate layer has a greater hardness than the cover. As with the cover material described below, pigments and various other additives may be included in the intermediate material.

The intermediate layer can be formed over the surface of the core using a known process, preferably an injection molding process. For example, once the core is placed within a mold, the intermediate layer material is injection molded over the core in a conventional manner.

The intermediate layer must have a greater hardness than the cover, which is described below. If the intermediate layer has a hardness which is the same as or lower than that of the cover, spin is not adequately suppressed when the ball is hit with a driver, in addition to which the ball has a lower rebound energy, preventing the anticipated total distance from being achieved. It is generally advantageous for the intermediate layer and the cover to have a Shore D hardness difference of at least 2, and preferably at least 5 units, but not more than 20, and preferably not more than 15 units.

It is recommended that the intermediate layer itself have a Shore D hardness of generally at least 50, and preferably at least 55, but not more than 67, and preferably not more than 65.

As already noted, the intermediate layer situated between the core and the cover in the golf ball of the invention has a greater hardness than the cover. The hardnesses of the intermediate layer and the core, when compared using the same hardness scale (i.e., JIS-C hardness or Shore D hardness), are preferably such that the intermediate layer has a greater hardness than the surface of the core. The JIS-C hardness difference between the intermediate layer and the core surface is preferably at least 2, and more preferably at least 6 units, but not more than 22, and more preferably not more than 18 units.

It is recommended that the intermediate layer have a thickness which is generally at least 0.5 mm, but not more than 3 mm, and especially not more than 2 mm. In cases where there are two or more intermediate layers, it is advisable to set the overall thickness of the intermediate layers within the above range.

If the golf ball has two or more intermediate layers situated between the core and the cover, the above-described hardness relationship must be maintained between the cover and the outer intermediate layer which is in close contact with the cover.

The cover of the golf ball is formed of a material which is softer than the intermediate layer material. Examples of suitable cover materials include ionomer resins and polyurethane thermoplastic elastomers which are softer than the intermediate layer material. The use of an ionomer resin is especially preferred.

It is advantageous for the cover to have a Shore D hardness of generally at least 45, and especially at least 48, but not more than 60, and especially not more than 58. A hardness value that is too low may result in increased spin and an inability to achieve the required total distance. On the other hand, a hardness value that is too high may adversely impact the controllability of shots taken with an iron club having a large loft angle, and approach shots.

A conventional process may be used to form the cover. It is especially preferable to use an injection molding process in which a solid core over which an intermediate layer has been formed is placed within a mold, and the cover material is injection molded over the intermediate layer.

It is recommended that the cover generally have a thickness of at least 0.6 mm, and preferably at least 1.0 mm, but not more than 2.1 mm, and preferably not more than 1.8 mm. Too thin a cover may lower the durability of the ball, whereas a cover that is too thick may lower the ball's rebound energy.

Since the golf ball of the invention has an optimized balance in hardness among the various layers as described above, the ball is endowed with an excellent rebound energy, distance performance, feel, controllability and spin characteristics.

For competition play, the golf ball of the invention may be formed so as to have a diameter and weight which conform with the Rules of Golf. That is, the ball may have a diameter of not less than 42.67 mm and a weight of not greater than 45.93 g.

The inventive golf ball provides increased distance when hit with a driver. On approach shots, the ball has excellent spin characteristics to ensure control as desired. Moreover, it has a good feel on impact. This combination of qualities enables the ball to satisfy the high expectations of skilled golfers in particular.

EXAMPLES

Examples of the invention and comparative examples are given below by way of illustration, and are not intended to limit the invention.

Examples 1-3 and Comparative Examples 1-5

To ascertain the flight characteristics and feel of golf balls according to one embodiment of the invention, golf balls with different hardnesses at the center and surface of the core were produced in Examples 1, 2 and 3. A number of additional examples were carried out for the purpose of comparison. The golf balls produced in Comparative Example 1 had cores with a small or flat hardness profile. The balls produced in Comparative Example 2 had cores with a noticeable, yet gradual, hardness profile. The balls produced in Comparative Example 3 had a core with a distinct hardness profile, but had an intermediate layer that was softer than the cover. The balls produced in Comparative Examples 4 and 5 similarly had cores with distinct hardness profiles, but lacked an intermediate layer. Comparative tests were conducted on these various balls.

The balls were all given the same arrangement of dimples on the surface of the cover. Namely, each ball had a total of 432 dimples of three types formed on the cover in an icosahedral arrangement.

Tables 1 and 2 below show the characteristics of the cover and intermediate layer in the ball samples in each example. Table 3 gives the characteristics of the core in the same balls, and Table 4 presents the test results obtained for each type of ball.

TABLE 1

| | | Example | | | Comparative Example | | | | |
|---|---|---|---|---|---|---|---|---|---|
| | | 1 | 2 | 3 | 1 | 2 | 3 | 4 | 5 |
| Cover | Material | a | a | a | a | a | b | a | a |
| | Thickness (mm) | 1.5 | 1.5 | 1.5 | 1.5 | 1.5 | 1.5 | 1.5 | 1.5 |
| | Hardness (Shore D) | 55 | 55 | 55 | 55 | 55 | 65 | 55 | 55 |
| Intermediate layer | Material | b | b | b | b | b | a | — | — |
| | Thickness (mm) | 1.5 | 1.5 | 1.5 | 1.5 | 1.5 | 1.5 | — | — |
| | Hardness (Shore D) | 65 | 65 | 65 | 65 | 65 | 55 | — | — |

TABLE 2

| Cover, intermediate layer | | a | b |
|---|---|---|---|
| Composition (parts by weight) | Himilan AM7317 (Zn)[1] | | 50 |
| | Himilan 1650 (Zn)[2] | 50 | |
| | Himilan AM7318 (Na)[3] | | 50 |
| | Surlyn 8120 (Na)[4] | 50 | |
| | Titanium oxide | 5 | 5 |
| Hardness | Shore D hardness | 55 | 65 |
| | JIS-C hardness | 80 | 94 |

[1]A zinc ionomer resin having an acid content of 18% made by DuPont-Mitsui Polychemicals Co., Ltd.
[2]A zinc ionomer resin made by DuPont-Mitsui Polychemicals Co., Ltd.
[3]A sodium ionomer resin having an acid content of 18% made by DuPont-Mitsui Polychemicals Co., Ltd.
[4]A sodium ionomer resin made by E. I. DuPont de Nemours and Co.

TABLE 3

| | | | Example | | | Comparative Example | | | | |
|---|---|---|---|---|---|---|---|---|---|---|
| | | | 1 | 2 | 3 | 1 | 2 | 3 | 4 | 5 |
| Core | Composition (pbw) | 1,4-cis-Polybutadiene | 100 | 100 | 100 | 100 | 100 | 100 | 100 | 100 |
| | | Zinc diacrylate | 41.0 | 38.0 | 35.0 | 28.0 | 27.8 | 38.0 | 32.1 | 28.4 |
| | | Peroxide (1)[1] | 0.6 | 0.6 | 0.6 | 0.6 | 0.6 | 0.6 | 0.6 | 0.6 |
| | | Peroxide (2)[2] | 0.8 | 0.8 | 0.8 | 0.6 | 0.6 | 0.8 | 0.8 | 0.8 |
| | | Sulfur[3] | 0.1 | 0.1 | 0.1 | 0 | 0 | 0.1 | 0.1 | 0.1 |
| | | Antioxidant[4] | 0 | 0 | 0 | 0.2 | 0.2 | 0 | 0 | 0 |
| | | Barium sulfate | 24.1 | 25.2 | 26.4 | 29.8 | 29.9 | 25.2 | 12.8 | 14.4 |
| | | Zinc oxide | 5 | 5 | 5 | 5 | 5 | 5 | 5 | 5 |

TABLE 3-continued

| | | | Example | | | Comparative Example | | | | |
|---|---|---|---|---|---|---|---|---|---|---|
| | | | 1 | 2 | 3 | 1 | 2 | 3 | 4 | 5 |
| | Zinc salt of pentachlorothiophenol | | 1 | 1 | 1 | 0.2 | 0.2 | 1 | 1 | 1 |
| Vulcanization conditions | Primary | Temperature (° C.) | 175 | 175 | 175 | 140 | 155 | 175 | 175 | 175 |
| | | Time (min) | 15 | 15 | 15 | 30 | 15 | 15 | 15 | 15 |
| | Secondary | Temperature (° C.) | — | — | — | 165 | — | — | — | — |
| | | Time (min) | — | — | — | 15 | — | — | — | — |
| Hardness | Surface (JIS-C hardness) | | 85 | 83 | 78 | 76 | 76 | 83 | 87 | 80 |
| | Center (JIS-C hardness) | | 61 | 59 | 55 | 72 | 60 | 59 | 63 | 56 |
| | JIS-C hardness difference | | 24 | 24 | 23 | 4 | 16 | 24 | 24 | 24 |
| Deformation under loading (mm)[5] | | | 3.4 | 3.8 | 4.1 | 3.3 | 3.4 | 3.8 | 3.4 | 4.1 |

[1]Dicumyl peroxide, produced by NOF Corporation under the trade name Percumyl D.
[2]1,1-Bis(t-butylperoxy)-3,3,5-trimethylcyclohexane, produced by NOF Corporation under the trade name Perhexa 3M-40.
[3]Zinc white-containing sulfur, produced by Tsurumi Chemical Industry Co., Ltd.
[4]Nocrack NS-6, produced by Ouchi Shinko Chemical Industrial Co., Ltd.
[5]Deformation under loading from an initial load of 98 N to a final load of 1,275 N.

TABLE 4

| | | Example | | | Comparative Example | | | | |
|---|---|---|---|---|---|---|---|---|---|
| | | 1 | 2 | 3 | 1 | 2 | 3 | 4 | 5 |
| Flight[1] | Carry (m) | 233.0 | 232.2 | 231.1 | 233.2 | 232.1 | 232.5 | 231.8 | 229.5 |
| | Total distance (m) | 241.2 | 243.8 | 244.9 | 238.5 | 239.9 | 245.5 | 238.3 | 241.1 |
| | Spin (rpm) | 2805 | 2745 | 2700 | 2910 | 2855 | 2550 | 2952 | 2847 |
| | Rating | good | good | good | poor | poor | good | poor | fair |
| Approach[2] | Spin (rpm) | 5833 | 5821 | 5811 | 5849 | 5830 | 4100 | 5870 | 5832 |
| | Rating | good | good | good | good | good | poor | good | good |
| Feel[3] | When hit with driver | good | good | good | good | good | good | good | poor |
| | When hit with putter | good | good | good | good | good | poor | good | good |

[1]Flight was rated as follows, based on distance measured when ball was hit at a head speed of 50 m/s by a driver mounted on a swing robot.
Good: Total distance at least 241 m
Fair: Total distance at least 241 m, but carry less than 230 m
Poor: Total distance 240 m or less.
[2]Approach was rated as follows, based on spin rate measured when ball was hit at a head speed of 19 m/s by a sand wedge mounted on a swing robot.
Good: Good spin (at least 5,500 rpm)
Poor: Inadequate spin (less than 4,500 rpm)
[3]Average sensory evaluations for five professional golfers:
Good: Feel was appropriate and good.
Poor: Feel was too hard or too soft.

As is apparent from the results in Table 4, the golf balls according to the invention all showed a good balance of distance, controllability on approach shots, and feel.

By contrast, the golf balls produced in the comparative examples each had drawbacks. In Comparative Examples 1 and 2, the hardness difference between the surface and center of the core was less than 18, resulting in much spin and a poor distance when the ball was hit with a driver. In Comparative Example 3, the cover was harder than the intermediate layer, and had an excessively high hardness. As a result, the amount of spin on approach shots was low and controllability was poor. In addition, the feel when hit with a putter was poor. The golf balls produced in Comparative Example 4 were two-piece balls which lacked between the cover and the core an intermediate layer of greater hardness than the cover. These balls had a lot of spin when hit with a driver, and thus a poor distance. In the golf balls produced in Comparative Example 5, the core hardness was lowered to reduce the high spin rate on impact with a driver in Comparative Example 4, but the resulting feel on impact with a driver was too soft.

Japanese Patent Application No. 2000-190640 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a rubbery elastic core having a center and a radially outer surface, a cover having a plurality of dimples on the surface thereof, and at least one intermediate layer situated between the core and the cover; wherein said intermediate layer is composed of a resin material which is harder than the cover and has a greater hardness than the surface of the elastic core when compared using the same hardness scale, and said elastic core has a hardness which gradually increases radially outward from the center to the surface thereof, and a difference in JIS-C hardness of at least 22 between the center and the surface.

2. The golf ball of claim 1, wherein said core at the center has a JIS-C hardness of 50 to 65, and at the surface a JIS-C hardness of 70 to 90.

3. The golf ball of claim 1, wherein said core undergoes a deformation of 3.0 to 5.0 mm when the load applied thereto is increased from an initial load of 98 N (10 kgf) to a final load of 1,275 N (130 kgf).

4. The golf ball of claim 1, wherein the difference in JIS-C hardness between the center of the elastic core and the surface thereof is 22 to 30 units.

5. The golf ball of claim 1, wherein the intermediate layer has a Shore D hardness of 50 to 67.

6. The golf ball of claim 1, wherein the JIS-C hardness difference between said intermediate layer and said core surface is 2 to 22 units.

7. The golf ball of claim 1, wherein the cover has a Shore D hardness of 45 to 60.

8. The golf ball of claim 1, wherein the golf ball has two or more intermediate layers situated between the core and the cover, and said hardness relationship is maintained between the cover and the outer intermediate layer which is in close contact with the cover.

9. The golf ball of claim 1, wherein the core is formed of rubber as a base and the cover is formed of materials including ionomer resins and polyurethane thermoplastic elastomers.

10. The golf ball of claim 1, wherein said elastic core is formed of rubber as the base material comprising an ingredient selected from a group consisting of thiophenol, thionaphthol, halogenated thiophenol and metal salt thereof.

11. The golf ball of claim 1, wherein said elastic core is formed of rubber as the base material comprising an ingredient selected from a group consisting of pentachlorothiophenol, pentafluorothiophenol, pentabromothiophenol, p-chlorothiophenol and the zinc salt of pentachlorothiophenol.

12. The golf ball of claim 1, wherein said elastic core is formed of rubber as the base material comprising an ingredient of zinc salt of pentachlorothiophenol added in an amount of 0.4 to 2.0 parts by weight, to per 100 parts by weight of the base rubber.

13. A golf ball comprising a rubbery elastic core having a center and a radially outer surface, a cover having a plurality of dimples on the surface thereof, and at least one intermediate layer situated between the core and the cover; wherein said intermediate layer is composed of a resin material which is harder than the cover, and has a greater hardness than the surface of the elastic core when compared using the same JIS-C hardness scale, and said elastic core has a hardness at the center and a hardness at the surface thereof which is greater than the hardness at the center thereof, and a difference in JIS-C hardness of at least 22 between the center and the surface.

14. The golf ball of claim 13, wherein said core at the center has a JIS-C hardness of 50 to 65, and at the surface a JIS-C hardness of 70 to 90.

15. The golf ball of claim 13, wherein the difference in JIS-C hardness between the center of the elastic core and the surface thereof is 22 to 30 units.

16. The golf ball of claim 13, wherein the intermediate layer has a Shore D hardness of 50 to 67.

17. The golf ball of claim 12, wherein the JIS-C hardness difference between said intermediate layer and said core surface is 2 to 22 units.

18. The golf ball of claim 12, wherein the cover has a Shore D hardness of 45 to 60.

19. The golf ball of claim 12, wherein the golf ball has two or more intermediate layers situated between the core and the cover, and said hardness relationship is maintained between the cover and the outer intermediate layer which is in close contact with the cover.

20. The golf ball of claim 12, wherein the core is formed of rubber as a base and the cover is formed of materials including ionomer resins and polyurethane thermoplastic elastomers.

21. The golf ball of claim 13, wherein said elastic core is formed of rubber as the base material comprising an ingredient selected from a group consisting of thiophenol, thionaphthol, halogenated thiophenol and metal salt thereof.

22. The golf ball of claim 13, wherein said elastic core is formed of rubber as the base material comprising an ingredient selected from a group consisting of pentachlorothiophenol, pentafluorothiophenol, pentabromothiophenol, p-chlorothiophenol and the zinc salt of pentafluorothiophenol.

23. The golf ball of claim 13, wherein said elastic core is formed of rubber as the base material comprising an ingredient of zinc salt of pentachlorothiophenol added in an amount of 0.4 to 2.0 parts by weight, to per 100 parts by weight of the base rubber.

24. A golf ball comprising a rubbery elastic core having a center and a radially outer surface, a cover having a plurality of dimples on the surface thereof, and at least one intermediate layer situated between the core and the cover; wherein said intermediate layer is composed of a resin material which is harder than the cover having a Shore D hardness of 45 to 58 and has a greater hardness than the surface of the elastic core when compared using the same hardness scale, and said elastic core has a hardness at the center and a hardness at the surface thereof which is greater than the hardness at the center thereof, and a difference in JIS-C hardness of at least 22 between the center and the surface.

25. The golf ball of claim 24, wherein said elastic core is formed of rubber as the base material comprising an ingredient selected from a group consisting of thiophenol, thionaphthol, halogenated thiophenol and metal salt thereof.

26. The golf ball of claim 24, wherein said elastic core is formed of rubber as the base material comprising an ingredient selected from a group consisting of pentachlorothiophenol, pentafluorothiophenol, pentabromothiophenol, p-chlorothiophenol and the zinc salt of pentachlorothiophenol.

27. The golf ball of claim 24, wherein said elastic core is formed of rubber as the base material comprising an ingredient of zinc salt of pentachlorothiophenol added in an amount of 0.4 to 2.0 parts by weight, to per 100 parts by weight of the base rubber.

* * * * *